US006718569B2

(12) United States Patent
Burger et al.

(10) Patent No.: US 6,718,569 B2
(45) Date of Patent: Apr. 13, 2004

(54) TUB AND SHOWER VALVE

(75) Inventors: Terry L. Burger, Mentor, OH (US); Thomas L. Falencki, Sheffield Village, OH (US); Darren S. Lopp, North Ridgeville, OH (US); Brian J. Schwartz, Huron, OH (US); Sharon M. Vilagi, Grafton, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 10/121,338

(22) Filed: Apr. 12, 2002

(65) Prior Publication Data

US 2003/0192116 A1 Oct. 16, 2003

(51) Int. Cl.[7] ..... E03C 1/042

(52) U.S. Cl. ..... 4/695; 4/675; 4/676; 137/270; 137/359

(58) Field of Search ..... 4/695, 675, 676, 4/677, 678; 137/359, 270, 360, 801

(56) References Cited

U.S. PATENT DOCUMENTS 4,896,381 A * 1/1990 Hutto ..... 4/695
5,031,658 A * 7/1991 Brattoli ..... 137/377
5,046,521 A * 9/1991 Jensen ..... 137/360
5,137,048 A * 8/1992 Brattoli ..... 137/269
5,340,018 A * 8/1994 MacDonald ..... 236/12.2
5,467,799 A 11/1995 Buccicone et al.
5,497,584 A * 3/1996 Bergmann ..... 52/34
5,518,019 A * 5/1996 Clare ..... 137/119.03
5,845,673 A * 12/1998 Paul ..... 137/360
6,070,609 A * 6/2000 Becker ..... 137/377
6,123,094 A * 9/2000 Breda ..... 137/98
6,422,520 B1 * 7/2002 Hand ..... 248/65
6,427,713 B1 * 8/2002 Dempsey et al. ..... 137/98

* cited by examiner

*Primary Examiner*—Henry Bennett
*Assistant Examiner*—Amanda Flynn
(74) *Attorney, Agent, or Firm*—Calfee, Halter & Griswold LLP

(57) ABSTRACT

A tub and shower valve assemble including a valve having a housing with an outwardly opening cup-like socket. A removable cartridge having an outwardly extending operating stem is installed in the cup-like socket. A plaster ground is provided for mounting the valve on a supporting wall structure. An escutcheon assembly is positioned over the valve housing and is removably attached to the plaster ground and to the valve housing and cartridge for removal and replacement of the cartridge. A transparent overlay is applied to the escutcheon with graphics and operating indicia applied to the underside of the overlay.

2 Claims, 10 Drawing Sheets

TUB AND SHOWER VALVE

BACKGROUND OF THE INVENTION

This invention is directed to a tub and shower water control valve, a plaster ground that supports the control valve on a wall and a decorative trim that surrounds the operating handle of the control valve and conceals the opening through the wall in which the control valve is mounted. tub and shower water control valves are equipped with interchangeable cartridges which permit the control valve to be used as a cycling valve or a volume control valve. It is advantageous to be able to interchange cartridges of these two types after the control valve has been installed in a wall without cutting into the wall or otherwise damaging it. A plaster ground is used to attach a control valve to the structure of a supporting wall or enclosure and also to protect the valve during the completion of the wall or enclosure by workers of other building trades. In addition to concealing the opening in the supporting wall through which the components of the water control valve extend to be connected to an operating handle, the escutcheon plate carries indicia, both in the form of letters and words as well as graphic symbols which are essential for the safe operation of the control valve. This indicia must remain legible over the life of the plumbing which can last many years. For this reason, the indicia applied to the escutcheon must be durable and withstand the use of abrasive cleaners applied to the surfaces of the escutcheon and handle as well as the moisture which is always present in tub and shower areas.

The present invention concerns a tub and shower water control valve, a plaster ground for supporting a control valve on the structure of an enclosing wall and an escutcheon which conceals from view the control valve and any openings in the wall associated with the control valve. The plaster ground must also protect the control valve and its cartridge during the construction of the wall after rough in of the plumbing. The escutcheon must depict operating instructions in the form of letters, words and graphics which will not be easily worn away or disfigured from moisture and abrasives used for cleaning in a tub and shower area.

SUMMARY OF THE INVENTION

The water control valve of this invention permits the alternate installation or replacement of a cycling cartridge or a volume control cartridge utilizing the same valve housing. The structure of the control valve also permits the removal and substitution of a cartridge for upgrading the control valve after the valve has been installed in the wall without requiring breaking into or damaging the wall. The valve housing of this invention is designed to increase flow rate through the valve cartridge while greatly reducing audible noise. The inlet and outlet ports and the tub and shower ports of the control valve may be connected to water pipes by threaded or soldered fittings. The control valve may be supported from below by a structural support member within the wall and will still be capable of being connected to its water supply pipes and to the shower and tub outlet pipes which are supplied through the cartridge. A cartridge housing extension sleeve is provided for installations in extra thick walls and to accommodate errors in locating the control valve in the wall. Mounting tabs are provided on the control valve to permit it to be attached to a support behind the control valve and also to attach the plaster ground and escutcheon to the valve body.

The plaster ground of the present invention can be assembled on the control valve at the factory so that it is ready for installation on thin walls such as glass fiber shower surrounds without any need for further assembly by the installing worker. A flat surface is formed on each of the top and bottom of the plaster ground body to permit the ground and control valve to be supported on a structural element of a wall extending beneath the ground. Nail receiving grooves are formed in the sides of the plaster ground body to permit the use of nails or screws to hold the control valve and plaster ground in position while the escutcheon is installed making the installation possible by only one installer. The plaster ground of this invention permits the control valve and ground to be installed in both thin and thick walls. It is clearly marked to indicate to the installer the correct position for each type of wall and can be changed from one thickness of wall to the other by inverting the ground and oriented it as indicated by markings on its face.

The tubular protective cover formed as part of the plaster ground protects the control valve and its cartridge before installation and during rough-in of the plumbing. The protective cover can be cleanly separated from the plaster ground base to present a flush surface for receiving the escutcheon and its sealing gasket.

The escutcheon can be provided with different overlays made of a clear durable plastic such as polycarbonate, with one overlay for a cycling cartridge and another overlay for a volume control cartridge. The plastic of the overlay is printed on its reverse side with lettering and/or graphics which can indicate its operation and the desired temperatures of the water. The overlay is adhered to the escutcheon with the printed material on the underside to protect the printed material against wear and tear.

DESCRIPTION OF THE PREFERRED EMBODIMENTS

Figure 2:
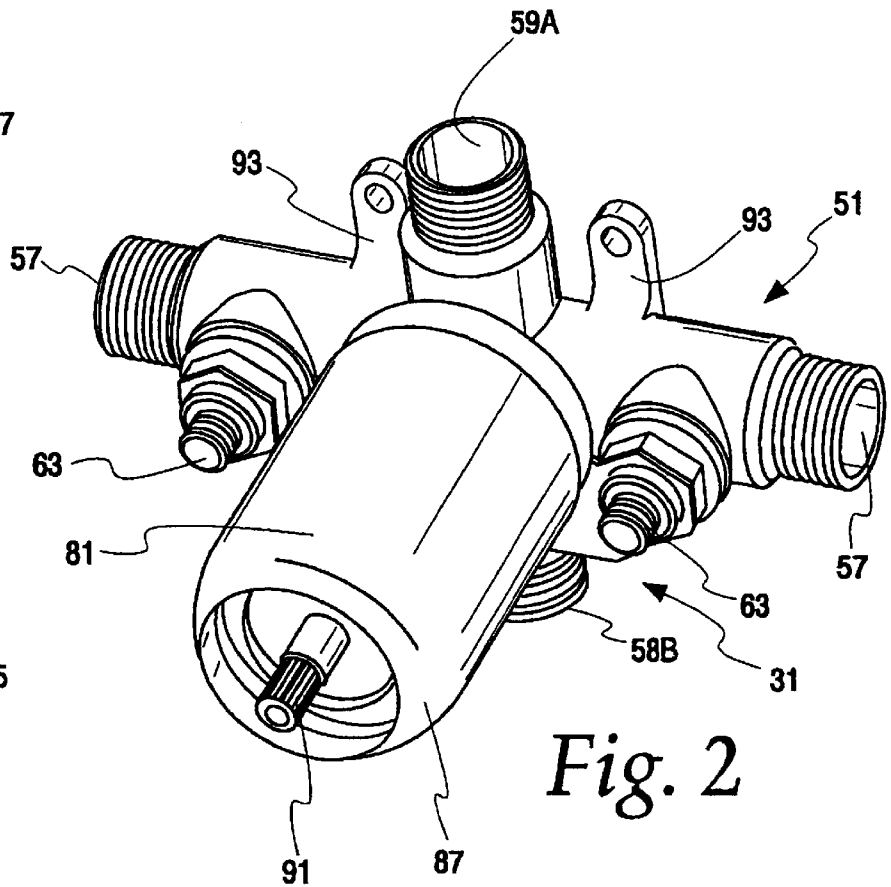
FIG. 2 is a perspective view of one version of the water control valve of this invention before its connection to the water piping.
Figure 1:
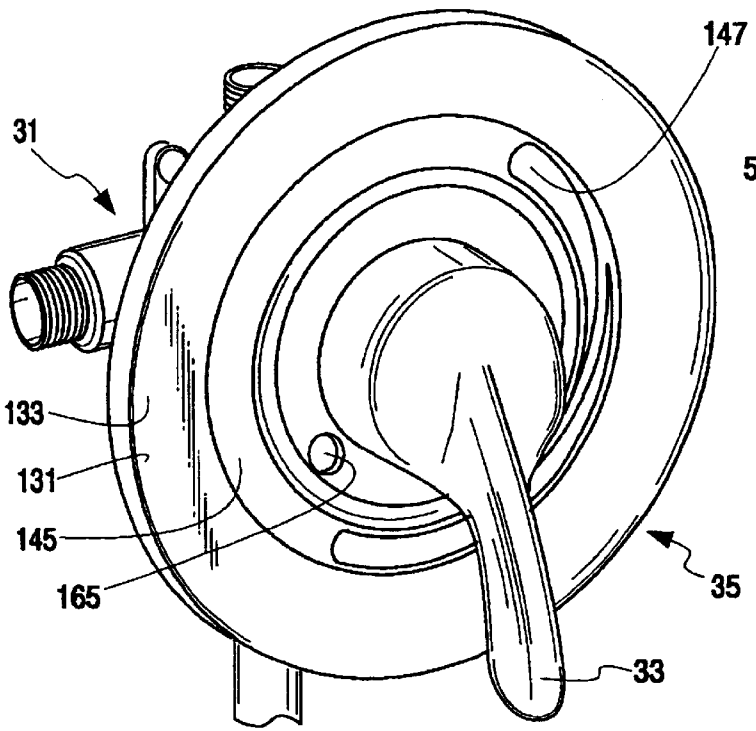
FIG. 1 is a perspective view of the operating handle and escutcheon with a portion of the control valve body also visible.
Figure 6:
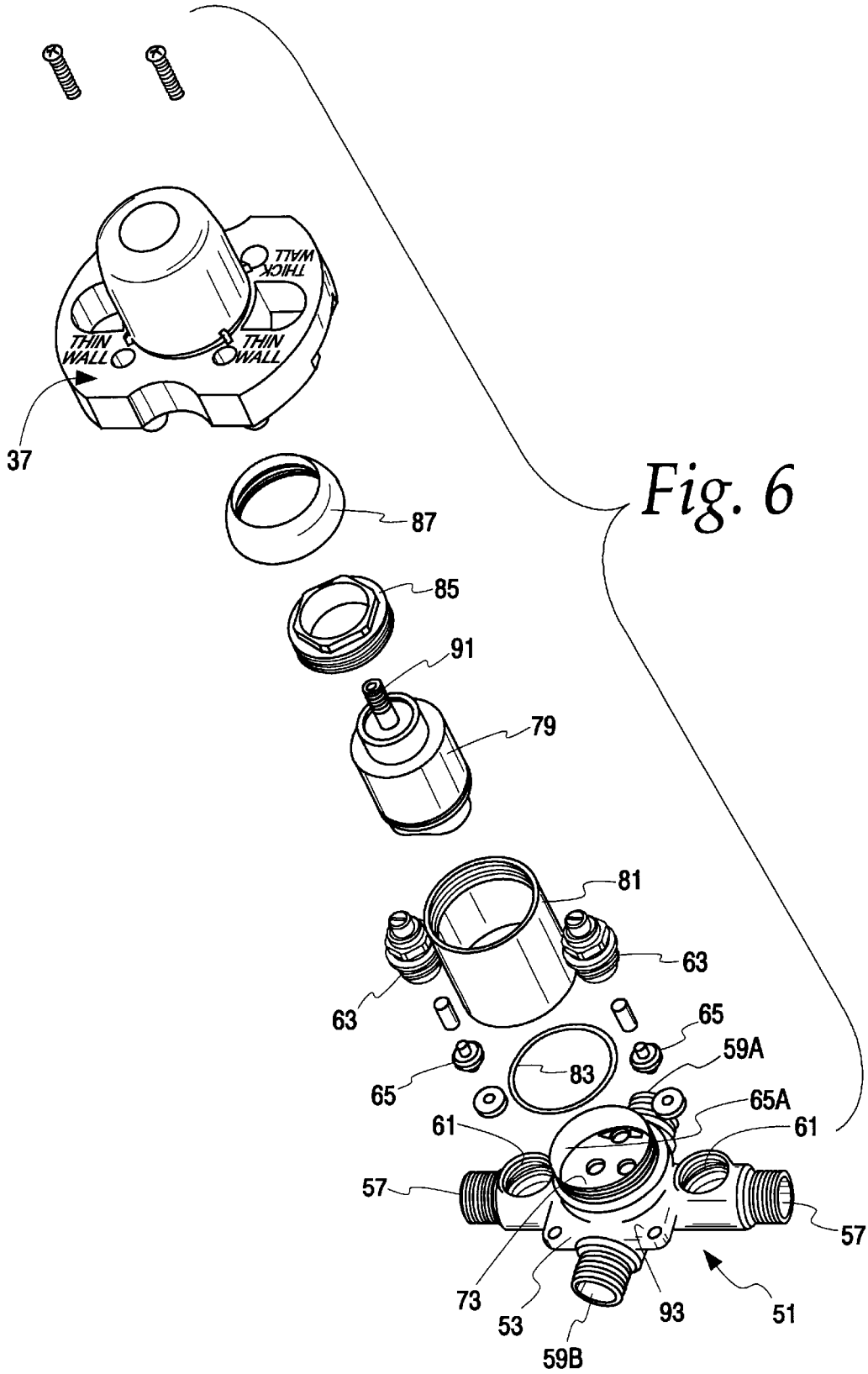
FIG. 6 is an exploded perspective of one embodiment of the control valve and the plaster ground.
Figure 24:
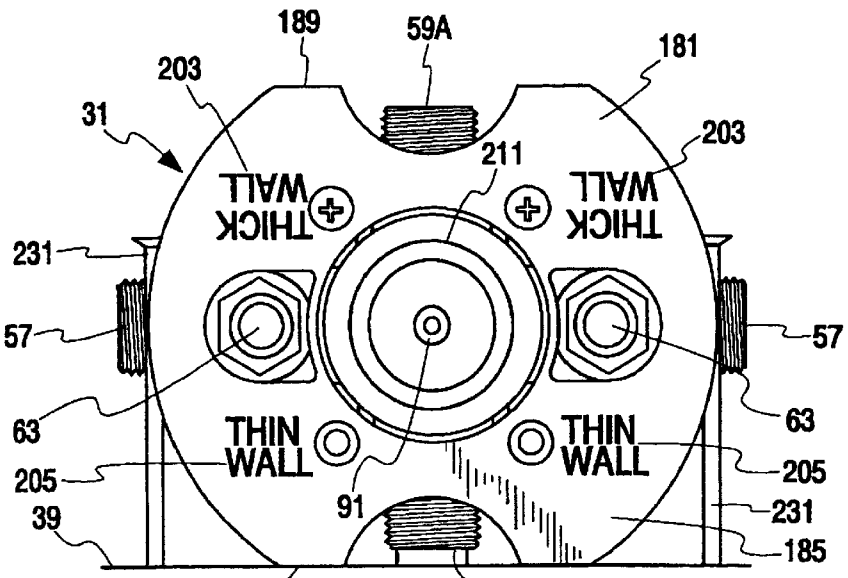
FIG. 24 is a front elevational view of the plaster ground attached to a control valve and mounted on a horizontal support member of a wall.
Figure 21:
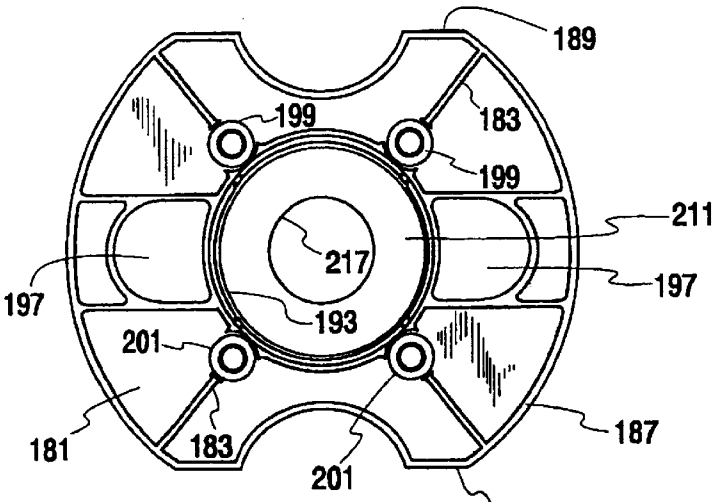
FIG. 21 is a rear elevational view of the plaster ground.
Figure 22:
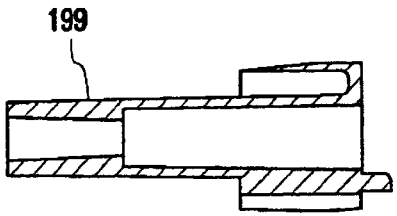
FIG. 22 is an enlarged axial cross-sectional view taken through the longer of the fastener receiving tubes.

FIG. 1 of the drawings shows the tub and shower valve of this invention in a demonstrative assembly mounted on a horizontal support of an uncompleted shower wall for ease of illustration. In this illustration, a control valve 31 is shown with a handle 33 and an escutcheon 35 of the type used with a shower cycling valve. The handle and escutcheon are fitted over a plaster ground 37 which is visible in FIGS. 6, 7 and 26 of the drawings. The control valve is supported on a horizontal support member 39 of the unfinished wall as shown in FIG. 24 of the drawings and because this is only a demonstrative illustration, the water connections to the control valve have not been installed.

The control valve 31, in its two embodiments, is shown in more details in FIGS. 6–16 and 28–29 and in its various positions of mounting in FIGS. 24–27. Referring now to FIGS. 2 and 6–11 of the drawings, because the control valve 31 is usually mounted in what will be called an upright or vertical orientation, the parts of the valve will be described using such orientation as a guide to the relative location of its components but it should be understood and appreciated that the control valve can be mounted other than upright. The control valve 31 includes a valve body 51 having front and rear faces 53 and 55, respectively. Hot and cold water inlets 57 and upper and lower water outlets 59A, 59B are formed in the valve body. It should be understood that the inlets 57 are connected to suitable hot and cold water supply pipes and the outlets 59A and 59B are connected to pipes extending to, for example, a shower head and a tub spout, respectively. It should be noted that the inlets and outlets are threaded for the use with threaded fittings and may also be connected to piping by the conventional sweating. It should further be noted that the water inlets and outlets 57 and 59A and 59B are located in the same plane which usually will be the horizontal aligned at what would be considered the base of the valve body 51. Check valve chambers 61 are located inwardly of the water inlets 57 and each chamber contains a check valve insert 63. The position of each check valve is controlled by a check stop assembly 65 and a check stop screw. The check valve inserts 63 prevent cross flow between the hot and cold water supplies as well as any siphoning into these supplies.

Figure 7:
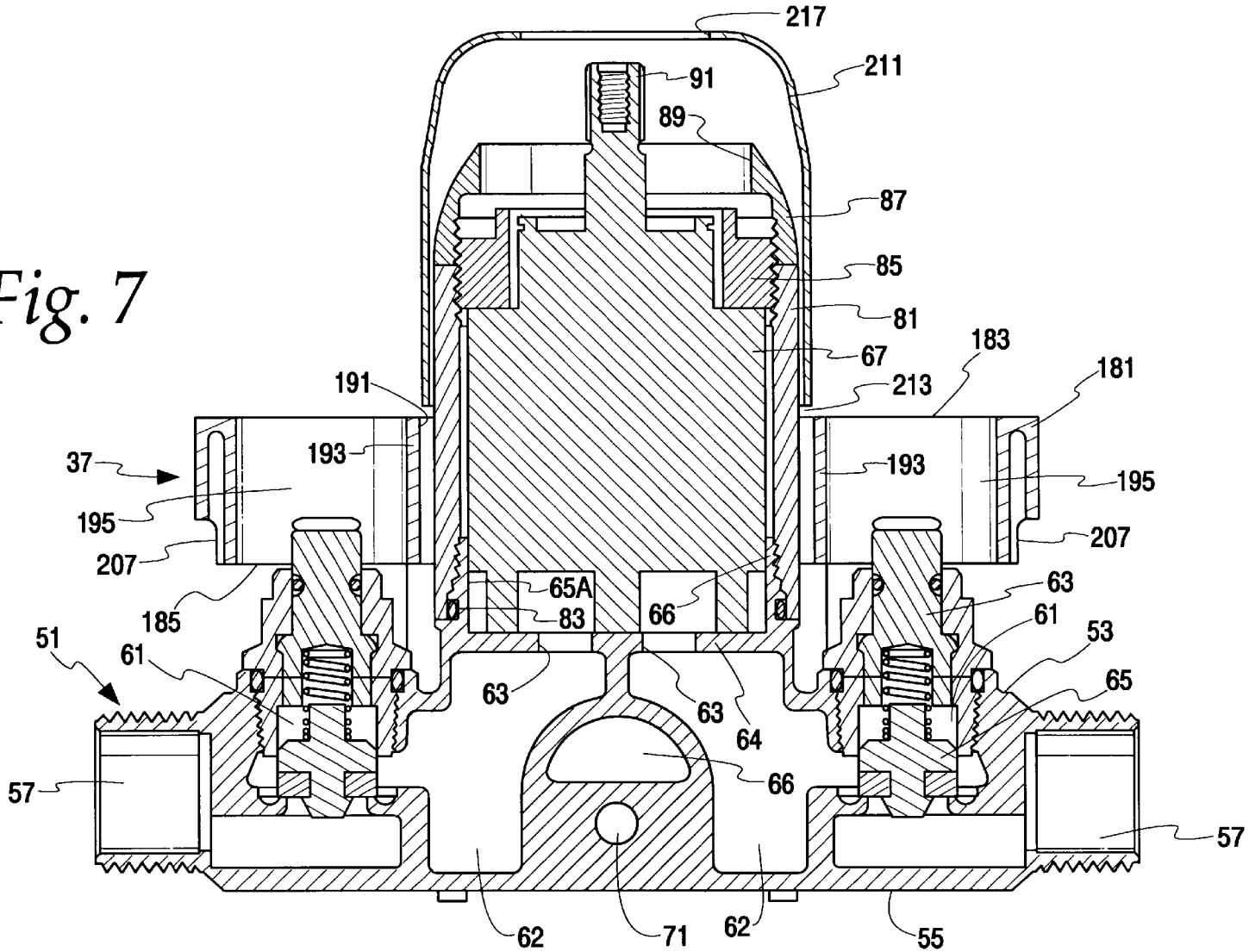
FIG. 7 is a cross-sectional view through one embodiment of the water control valve cartridge and the plaster ground.
Figure 11:
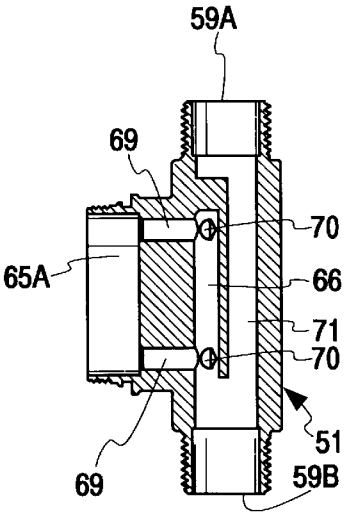
FIG. 11 is a cross-sectional view taken along line 11—11 of FIG. 8.
Figure 9:
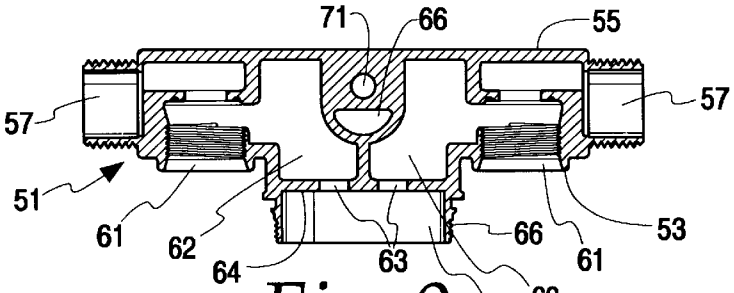
FIG. 9 is a cross-sectional view taken along line 9—9 of FIG. 8.
Figure 8:
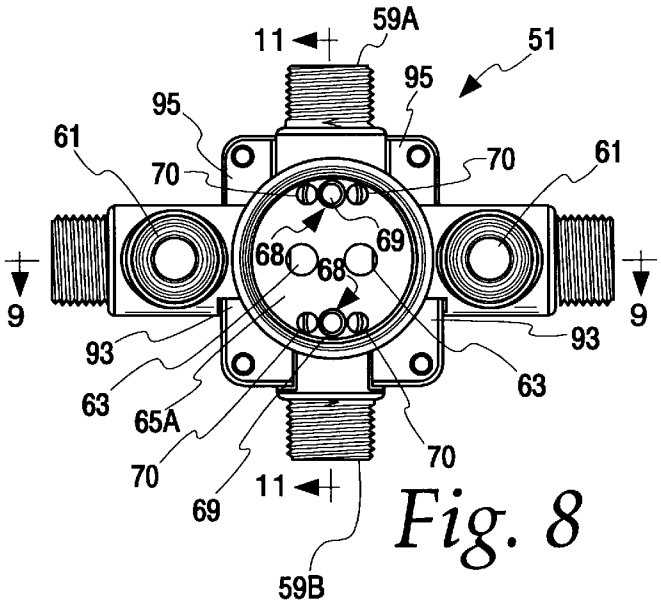
FIG. 8 is a top plan view of a first embodiment of the control valve.
Figure 12:
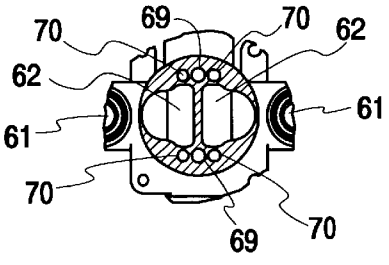
FIG. 12 is a partial cross-sectional view taken along line 12—12 of FIG. 10.
Figure 10:
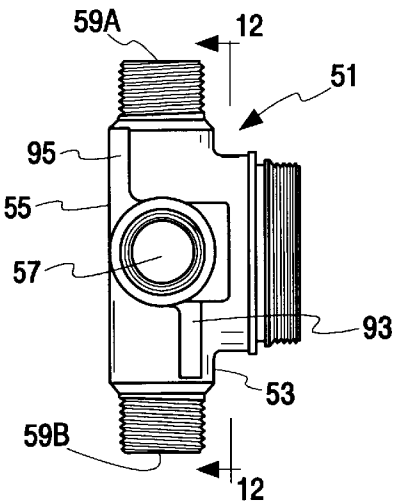
FIG. 10 is a side elevational view of the control valve of FIG. 8.

The check valve chambers 61 are seen most clearly in FIG. 7 of the drawings. Each leads into a separate chamber 62, one for the hot water and one for the cold water. Water passages 63 formed in the top wall 64 of these chambers open into a cup-like socket 65A defined by an annular wall 66 formed as part of the valve body 51. A valve cartridge 67, which may be of the type used cor cycling or the type used for volume control is seated in the cup-like socket 65A defined by an annular wall 66 formed as part of the valve body 51. A valve cartridge 67, which may be of the type used for cycling or the type used for volume control is seated in the cup-like socket 65A. Hot and cold water from the separate chambers 62 mix in the valve cartridge 67. The mixed water exits the valve cartridge through two sets 68 of passages, which can be best seen in FIG. 8 of the drawings, are located 1800 apart and are at the outer periphery of the cup-like socket 65A. The sets of passages lead into a tub and shower supply passage 66 of the valve body 51 as shown in FIG. 11. Each set 68 of passages includes a central passage 69 and a pair of laterally located passages 70. The central passage of each set is larger in diameter than the laterally located passages 70 and may also function as an indexing socket for the valve cartridge 67. The tub and shower passage 66 connects to a shower passage 71 which also functions as a shower drain and which is shown most clearly in FIG. 11 of the drawings. A threaded sleeve 81 connects to the annular wall 66 with an O-ring seal 83 positioned between the annular wall and the threaded sleeve. A cartridge nut 85 locks the valve cartridge 67 to the threaded sleeve. A dome 87 with a central opening 89 fastens to the threaded sleeve and to the cartridge nut. A stem 91 of the valve cartridge extends through the central opening in the dome 87. As shown most clearly in FIGS. 2, 6, 8 and 10 of the drawings, the valve body 51 is provided with two sets of integrally formed mounting tabs. One set of mounting tabs is located at the lower portion of the front face of the valve body.

Figure 14:
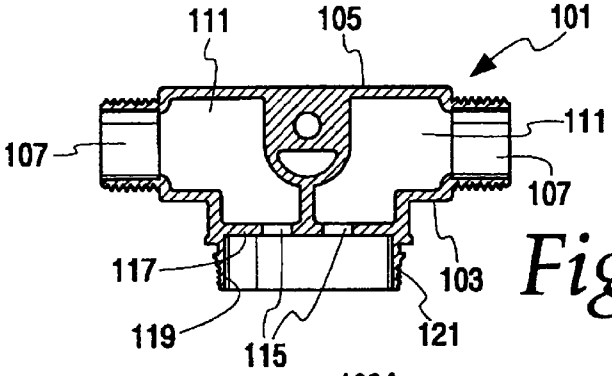
FIG. 14 is a cross-sectional view taken along line 14—14 of FIG. 13.
Figure 13:
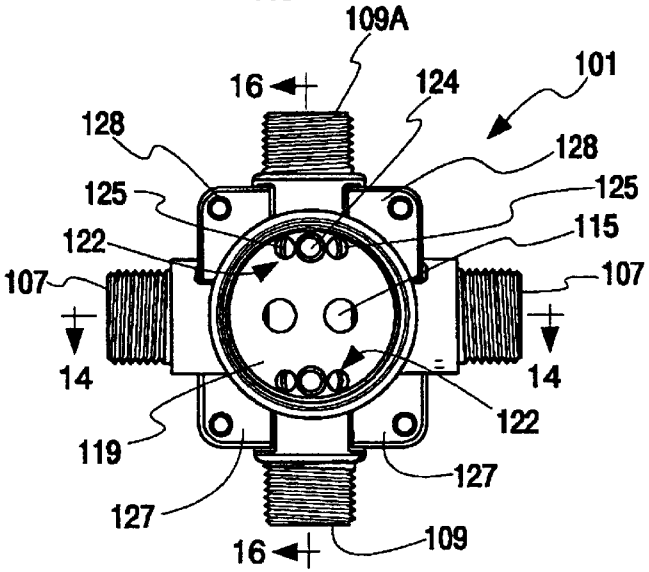
FIG. 13 is a top plan view of a second embodiment of a control valve of this invention.
Figure 16:
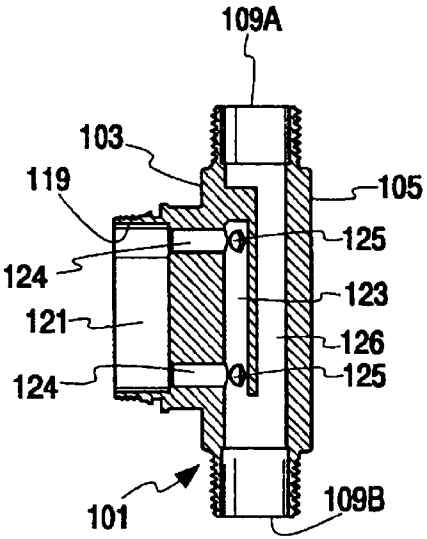
FIG. 16 is a cross-sectional view taken along line 16—16 of FIG. 13.
Figure 15:
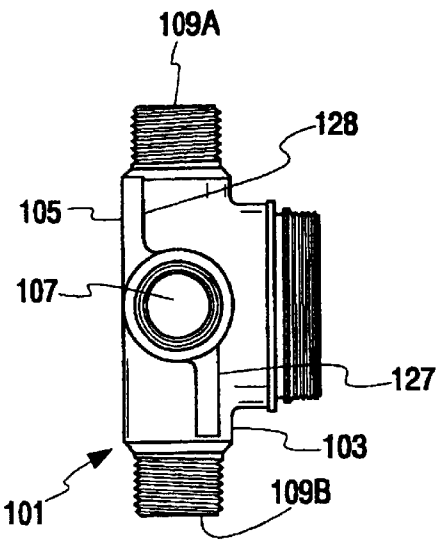
FIG. 15 is a side elevational view of the valve of FIG. 13.
Figure 20:
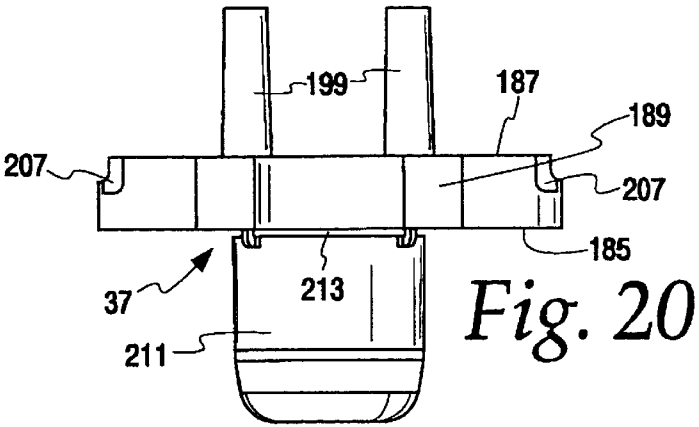
FIG. 20 is a top plan view of the plaster ground.
Figure 17:
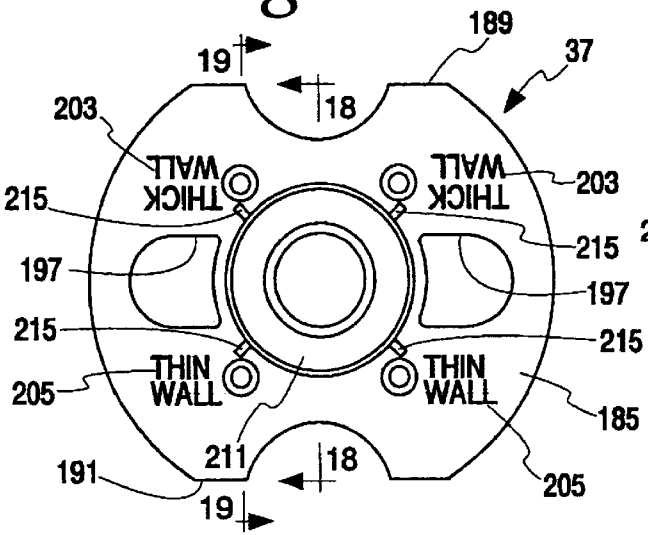
FIG. 17 is a front elevational view of the plaster ground of this invention.
Figure 18:
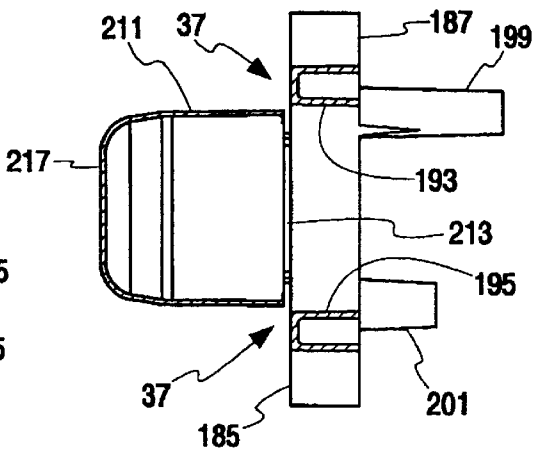
FIG. 18 is a cross-sectional view of the plaster ground taken along line 18—18 of FIG. 17.
Figure 19:
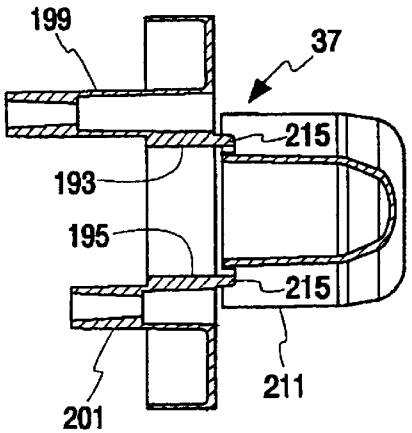
FIG. 19 is a cross-sectional view of the plaster ground taken along line 19—19 of FIG. 17.
Figure 23:
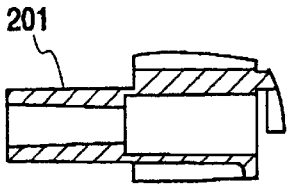
FIG. 23 is an enlarged axial cross sectional view taken through one of the shorter of the fastener receiving tubes.

A valve body 101, which is a modified version of valve body 51, is shown in detail in FIGS. 14 to 16 of the drawings. It functions in the same manner as the valve body 51 but does not have check chambers or check valve inserts as does the valve body 51. The modified body 101 has a front face 103 and a rear face 105. Hot and cold water inlets 107 are formed integrally with the body as are upper and lower water outlets 109A and 109B, respectively. The valve body includes separate chambers 111, one for the hot water and one for the cold water, to supply water to the upper and lower water outlets 109A and 109B. Water passages 115 in the top wall 117 of the valve body 101 lead into a cup-like socket 119 which opens to the front face of the valve body. An annular wall 121 surrounds the cup-like socket and is adapted to receive the threaded sleeve 81 and O-ring 83 in the manner previously described. A valve cartridge, which may be a cycling or volume control type such as that previously described, may be seated in the cup-like socket 119. Hot and cold water from the separate chambers 111 mix in the valve cartridge 67. The mixed water exits the valve cartridge through two sets 122 of passages extending through the top wall 117 of the chambers 111. These sets of passages, which can best be seen in FIG. 13 of the drawings, are located 180° apart and are at the outer periphery of the cup-like socket 119. The set of passages lead into a tub and shower supply passage 123 of the valve body 101 as shown in FIG. 16 of the drawings. Each set 122 of passages includes a central passage 124 and a pair of laterally located passages 125. The central passage of each set is larger in diameter than the laterally located passages 125 and may also function as an indexing socket for the valve cartridge 67. The tub and shower passage 123 connects to a shower passage 126 which also functions as a shower drain and which is shown most clearly in FIG. 16 of the drawings. The valve body 101 includes mounting tabs 127 located at the front face of the valve body and mounting tabs 128 located at the rear face of the valve body as shown most clearly in FIG. 13 of the drawings.

Figure 4:
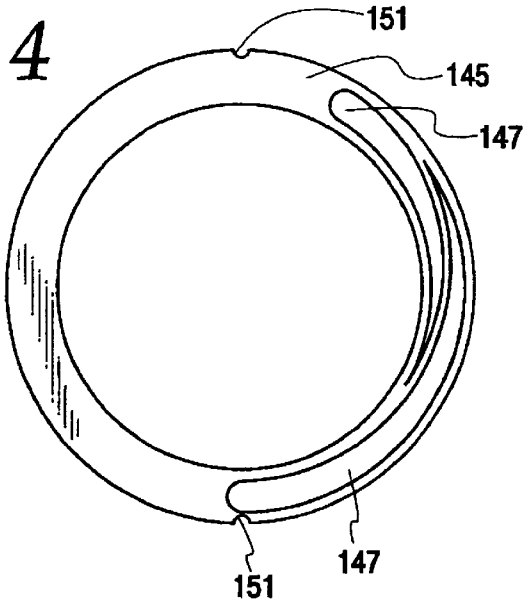
FIG. 4 is a plan view of one embodiment of the escutcheon overlay with indicia for a cycling valve.
Figure 5:
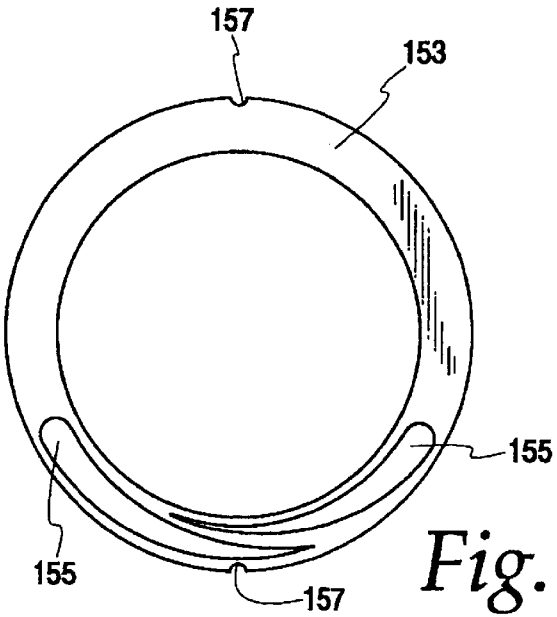
FIG. 5 is a plan view of another embodiment of the escutcheon overlay with indicia for a volume control valve.
Figure 3:
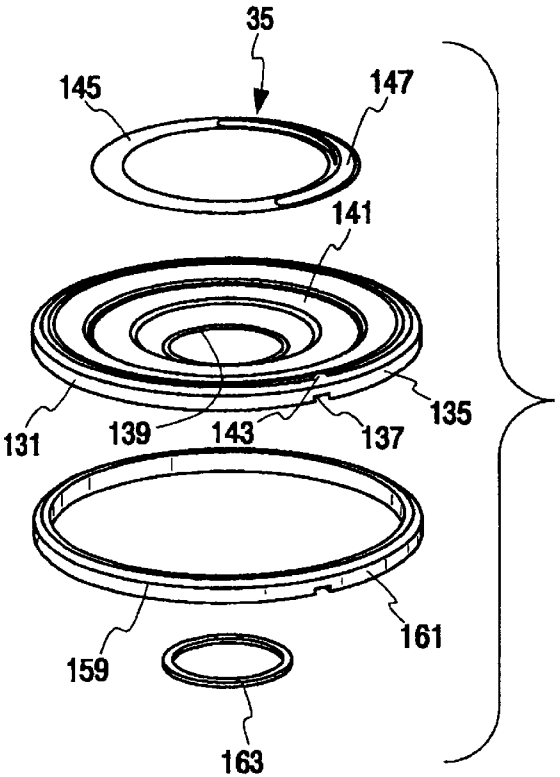
FIG. 3 is an exploded perspective view of the escutcheon assembly.

The escutcheon 35 is shown installed on the control valve 31 in FIG. 1 of the drawings. It is also shown in exploded detail in FIG. 3 of the drawings. The escutcheon includes an annular disk 131 formed of a brass alloy that is nickel plated. The disk includes a front face 133 and has an outer peripheral wall 135 which extends rearwardly of the front face. An indexing notch 137 is cut in the edge of the rearwardly extending wall. A central opening 139 extends through the annular disk and located radially outwardly of the central opening is an annular area 141 formed on the front face. An upstanding indexing bead 143 is formed in the disk at the outer periphery of the annular area 141. An overlay 145 formed of a transparent plastic such as polycarbonate is sized to be positioned on the annular area 141 and held there by an adhesive. Graphics 147 applied to the rear surface of the overlay 145 are visible from the front face 133 of the escutcheon 35 as can be seen in FIGS. 3 and 4 of the drawings. Notches 151 are formed in the outer peripheral edges of the overlay and are located 180° apart to provide for indexing of the overlay relative to the annular disk 131. The graphics 147 applied to the reverse side of the overlay indicate proper operation of a cycling valve cartridge installed in the control valve 31. A modified form of transparent overlay 153, shown in FIG. 5, is marked with graphics 155 on its rear face and visible from the front face of the overlay to indicate a volume control valve installed in the control valve 31. Indexing notches 147 are formed in the outer peripheral edge of the annular overlay 153 and are located 180° apart relative to each other. The annular overlays 145 and 153 are interchangeable on the escutcheon annular disk 131 permitting the use of a single escutcheon for two types of cartridge valves. An annular gasket 159 is provided for the escutcheon disk 131 and is provided with an indexing notch 161. A gasket 163 is provided for the central opening. The escutcheon plate is provided with two fastener passages 165, one of which is visible in FIG. 1 of the drawings and the other is concealed by the handle 33. The fastener passages are located radially inwardly of the annular transparent plastic overlay 145.

The plaster ground 37 if this invention is shown in detail in FIGS. 6, 7 and 17–23 of the drawings and installed in FIGS. 24, 25, 26 and 27. The plaster ground includes a base 181 which is injection molded of a suitable plastic with the walls being relatively thin and reinforced by internal webs 183. The plaster ground has a front face 185 and a rear face 187. A peripheral wall around the base 181 has a top supporting surface 189 and a bottom supporting surface 191. A central opening 193 extends through the base from front to rear. A rearwardly extending interior wall 195 surrounds the central opening 193. A pair of openings 197 through the base are formed on opposite sides of the central opening. Sets of fastener tubes 199 and 201 are formed integrally with the base 181 and extending rearwardly thereof. The fastener tubes 199 are longer than the fastener tubes 201. Indicia reading "Thin wall" and "Thick wall" to indicate the mounting orientation of the base on a horizontal support in a wall are provided on the front face 183 of the tube base. The indicia 203 indicate the orientation for a thick wall are provided on the front face 183 of the base. The indicia 203 indicate the orientation for a thick wall and are positioned adjacent the fastener tubes 199. The indicia 205 indicate the orientation for a thick wall and are positioned adjacent the fastener tubes 199. The indicia 205 indicating the orientation of the base for a thin wall is located on the face of the base adjacent the shorter fastening tubes 201. Nail receiving notches 207 are formed in the peripheral wall of the plaster ground.

A tubular cover 211 formed of the same injection molding plastic as that of the base 181 of the plaster ground is attached to the front face of the plaster ground with a gap 213 located between the cover and the base 181. The cover is supported on the base 181 by L-shaped mounting tabs 215 arranged around the periphery of the tubular cover. An opening 217 at the distal end of the tubular cover permits the cartridge stem to extend therethrough.

Figure 28:
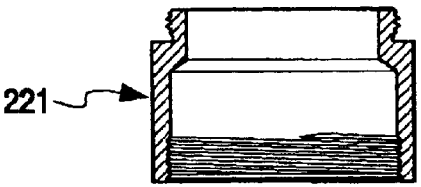
FIG. 28 is a cross-sectional view of an extension sleeve for a cartridge valve.
Figure 29:
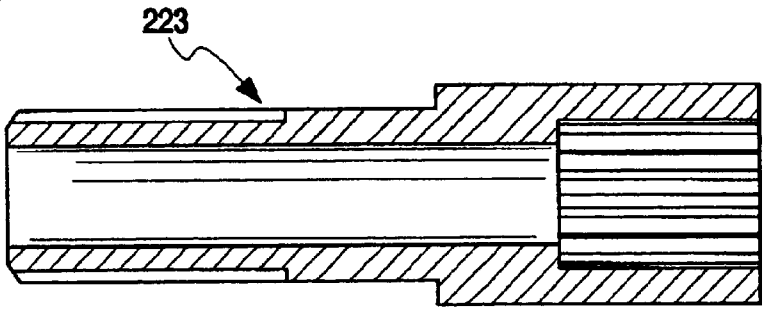
FIG. 29 is a cross-sectional view of a stem extension for a cartridge valve.

FIGS. 28 and 29 of the drawings show a tubular sleeve extension 221 for cartridge sleeve 181 and a cartridge stem extension 223 to provide operating access to the cartridge stem when the tubular extension sleeve is installed.

Figure 25:
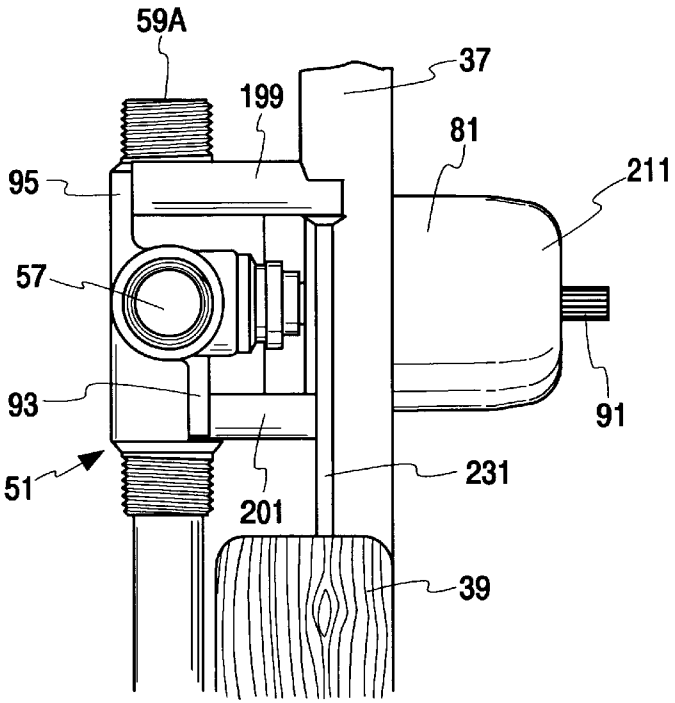
FIG. 25 is a side elevational view of the control valve and plaster ground installed in the structure in a "thin wall" enclosure.

In FIGS. 24 and 25 of the drawings, the plaster ground 37 is shown installed on a horizontal support member 39 and is being held by nails 231 driven through notches 207 formed in the side walls if the base. Note that the plaster ground is installed for what is called a thin wall shown in FIG. 25 of the drawings. In the thin wall installation, the longer fastener receiving tubes 199 are positioned at the top of the valve body 51 and engage the mounting tabs 95 at the rear face of the valve body 51. The shorter fastener tubes 201 contact the mounting tabs 93 at the front face of the valve body 51 and will receive fasteners to hold the escutcheon plate in position. As shown in FIG. 25 of the drawings, this arrangement is particularly useful for installation of the control valve in a wall having a 2" thick stud with a total wall thickness of 3". This type of connection is particularly useful with modern flexible plastic piping. It should be noted in FIG. 25 that the plaster ground 37 us mounted on top of the horizontal support member 39 in order to conserve the limited front to rear space within the thin wall.

Figure 26:
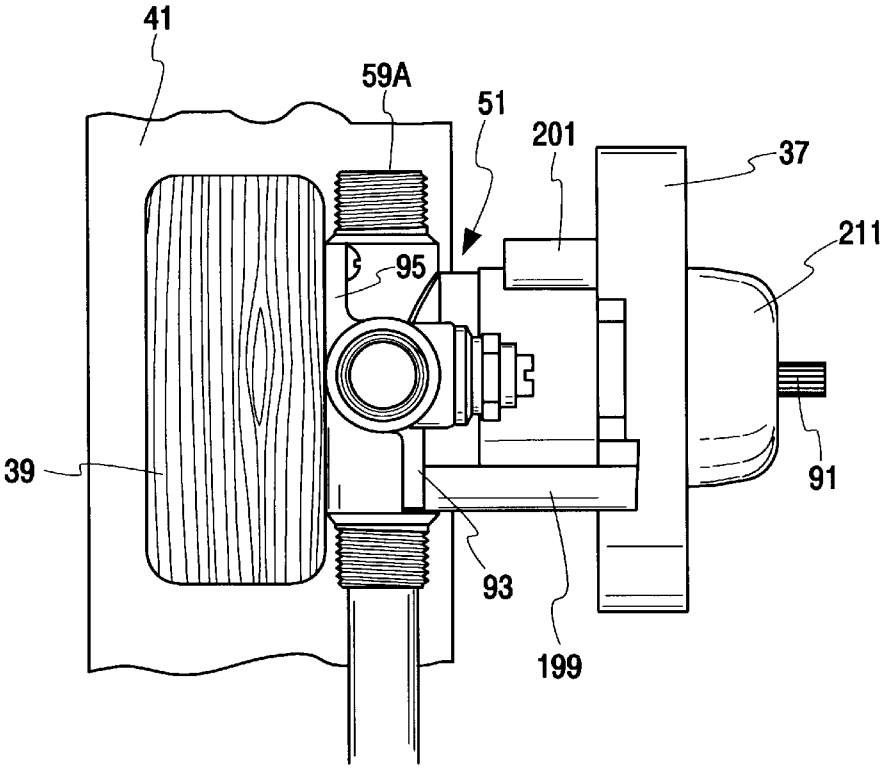
FIG. 26 is a side elevational view of the plaster ground and control valve installed on a horizontal wall support of a "thick wall" installation.

FIG. 26 of the drawings shows the plaster ground 37 and control valve 31 installed in what is called a thick wall installation. The plaster ground 37 will accommodate a finished wall having an outer covering up to 2" thick. In this arrangement, fasteners extending through the mounting tabs 95 at the rear of the valve body 51 attach the valve body to the front face of a horizontal support member 39. The plaster ground 37 is inverted from its position shown in FIG. 24 in order to position the longer set of fastener tubes 199 below the shorter set of fastener tubes 199. The longer set of fastener tubes 199 are attached by fasteners (not shown in FIG. 26) which extend through the plaster ground and the longer set of fastener tubes 199 to engage the mounting tabs 93 on the front of the valve body. This arrangement allows the wall covering to be installed in the space between the front face of the vertical stud 41 and the front face 185 of the plaster ground. This distance can be up to 2". With the thick wall installation, the plaster ground is removed before the wall covering material is installed.

Figure 27:
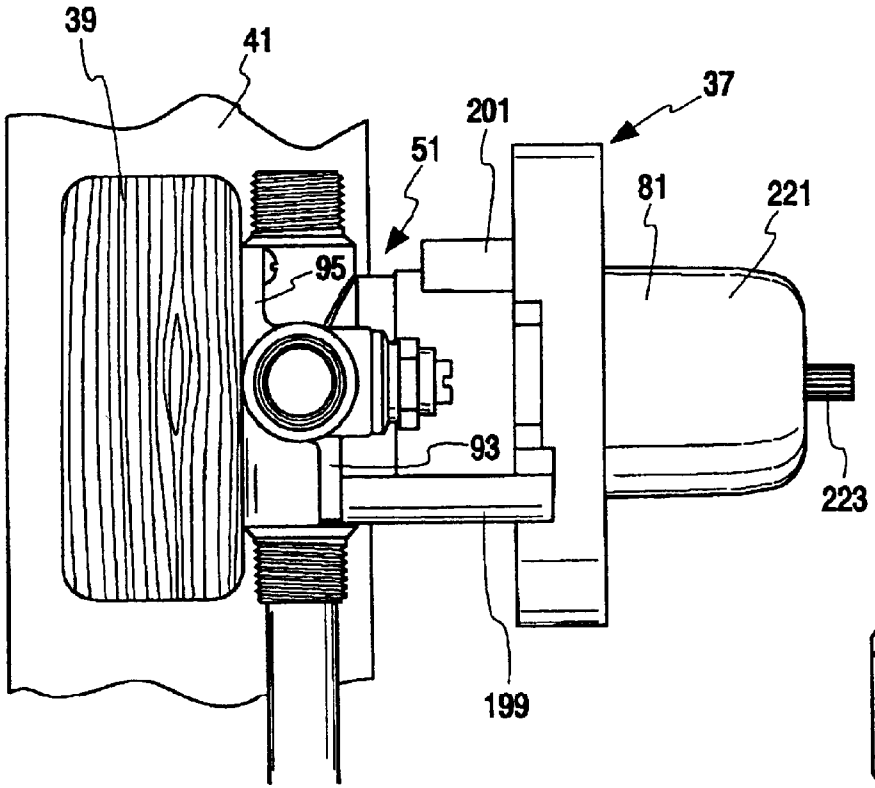
FIG. 27 is a side elevational view of the plaster ground and control valve installed on a horizontal wall support of a thick wall with an extension sleeve provided on the control valve cartridge.

FIG. 27 of the drawings shows the installation of the control valve 31 of this invention in a supporting wall where the finished wall covering material can be up to 3" thick. This is accomplished by the installation of the tubular extension sleeve 221 to the sleeve 81 which encloses the valve cartridge 79. The use of the extension sleeve provides a one inch extension of the valve body 101. To provide access to the cartridge stem 91, a cartridge stem extender 223 engages the cartridge stem and extends outwardly of the cartridge dome 87 which is fastened on the outer end of the tubular extension sleeve 221. In addition to providing for the installation of wall covering material up to 3" thick, the tubular extension sleeve 221 may also be utilized when the control valve body 51 is accidentally installed deeper in the wall than was originally expected so it can also be used with wall covering materials that are less than 3" thick.

What is claimed is:

1. A tub and shower valve assembly, including:

a valve having a body with a front face and a rear face, at least one mounting tab located at said front face and at least one mounting tab located at said rear face of said body, a plaster ground attached to said mounting tabs of said body by fasteners, said plaster ground including at least two fastener receiving tubes with each of said tubes aligned with and engaging one of said mounting tabs, one of said tubes extending a greater distance rearwardly of said plaster ground than said other fastener tube.

2. The tub and shower valve assembly of claim 1 including at least four fastener receiving tubes, two of said tubes extending a greater distance rearwardly of said plaster ground than said other two fastener tubes with said longer tubes aligned with said mounting tabs at said rear face of said body.

* * * * *